US006945469B2

(12) United States Patent
Tanaka et al.

(10) Patent No.: US 6,945,469 B2
(45) Date of Patent: Sep. 20, 2005

(54) PRESSURE-STORAGE TYPE FUEL INJECTION DEVICE FOR INTERNAL COMBUSTION ENGINES

(75) Inventors: Hirohisa Tanaka, Tokyo (JP); Takahiro Urai, Hiratsuka (JP)

(73) Assignee: Moog Japan Ltd., Kanagawa (JP)

( * ) Notice: Subject to any disclaimer, the term of this patent is extended or adjusted under 35 U.S.C. 154(b) by 269 days.

(21) Appl. No.: 10/204,121

(22) PCT Filed: Feb. 27, 2001

(86) PCT No.: PCT/JP01/01468

§ 371 (c)(1),
(2), (4) Date: Aug. 14, 2002

(87) PCT Pub. No.: WO01/63118

PCT Pub. Date: Aug. 30, 2001

(65) Prior Publication Data

US 2003/0015600 A1 Jan. 23, 2003

(30) Foreign Application Priority Data

Feb. 28, 2000 (JP) ..... 2000-051426

(51) Int. Cl.[7] ..... F02M 47/02; F02M 41/16; F02M 39/00

(52) U.S. Cl. ..... 239/96; 239/88; 239/533.3; 239/585.1

(58) Field of Search ..... 239/96, 88–95, 239/533.2, 533.3, 533.8, 533.7, 533.9, 585.1–585.5; 251/129.15, 129.21

(56) References Cited

U.S. PATENT DOCUMENTS

| | | | | | |
|---|---|---|---|---|---|
| 5,636,615 | A | * | 6/1997 | Shorey et al. | 123/506 |
| 6,036,120 | A | * | 3/2000 | Varble et al. | 239/585.1 |
| 6,073,862 | A | * | 6/2000 | Touchette et al. | 239/408 |
| 6,279,842 | B1 | * | 8/2001 | Spain | 239/585.1 |

FOREIGN PATENT DOCUMENTS

| | | |
|---|---|---|
| EP | 0789142 | 8/1997 |
| EP | 0971115 | 1/2000 |
| JP | 9-144706 | 6/1997 |
| WO | WO97/08452 | 3/1997 |

* cited by examiner

*Primary Examiner*—Davis Hwu
(74) *Attorney, Agent, or Firm*—Jenkens & Gilchrist, P.C.

(57) ABSTRACT

A fuel injection device is so constructed that fuel fed from a pressure storage chamber to a valve housing (11) with a nozzle (14) is led to a needle valve back pressure chamber (16) through a groove (21) provided on the peripheral surface of a needle valve (17); a fuel pressure in the back pressure chamber (16) is controlled by opening and closing a pressure regulating port (13) provided in the valve housing by a pilot valve (38) so as to move the needle valve, whereby the nozzle is opened and closed. The pressure regulating port is opened and closed by a drive control of the pilot valve with a valve drive unit by means of elongation and contraction of the magnetostrictive rods attributable by the action of an external magnetic field. The magnetostrictive rods, consisting of first and second magnetostrictive rods (34 and 35), are axially arranged side by side in parallel to the pilot valve.

7 Claims, 4 Drawing Sheets

PRESSURE-STORAGE TYPE FUEL INJECTION DEVICE FOR INTERNAL COMBUSTION ENGINES

TECHNICAL FIELD

The present invention relates to a pressure-storage type fuel injection device for internal combustion engines, and more particularly to a pressure-storage type fuel injection device for internal combustion engines equipped with a pilot valve drive unit utilizing elongation of a magnetostrictive material by a magnetic field effect.

BACKGROUND ART

From the viewpoint of conserving the global environment, the need to reduce nitrogen oxides (NOx), black smoke, particles and other emissions contained in the exhaust gas of internal combustion engines, including among others diesel engines, is posing a major challenge.

One of the known means for addressing the emission problem according to the prior art is a pressure-storage type (a common rail type) high pressure fuel injection device capable of injecting a constant quantity of fuel independent of the engine speed, controlling the injection pressure and the injection timing independent of each other, and easily performing split injection (pilot injection). Whereas this pressure-storage type high pressure fuel injection device has a two stage fuel injection valve using a small on/off electromagnetic valve as a pilot valve, as it uses a stationary orifice for controlling the hydraulic force to open and close the needle valve, the injection rate pattern (the shape of the graphically expressed injection rate, i.e. the waveform representing variations in the injection rate over time) is a fixed rectangle, and a steep rise of the initial injection volume leads to an increase in nitrogen oxide (NOx) emission.

In order to effectively reduce harmful substances in exhaust gas, it is necessary to elaborately control the injection rate by not only regulating the fixed injection rate but also by selecting the optimal injection rate pattern according to variations in the engine speed, engine load level and common rail pressure.

DISCLOSURE OF INVENTION

Therefore, an object of the present invention is to provide a fuel injection device capable of variably controlling the injection rate pattern (transitional variations) under a broad range of injection pressure, from a low pressure to a high pressure.

The above object is attained by providing a pressure-storage type fuel injection device for internal combustion engines described below, which uses a mechanism of driving a pilot valve by taking advantage of characteristics of a magnetostrictive material.

A pressure-storage type fuel injection device for internal combustion engines with a pilot valve drive unit, which comprises:

a valve housing having a nozzle at one end; a needle valve reciprocally installed in a valve or inner chamber of the valve housing; and a pilot valve drive unit provided with a pilot valve for controlling the fuel pressure applied to the rear end of the needle valve, a fuel inlet port and a pressure regulating port being formed in the valve housing, wherein fuel fed from the fuel inlet port into the valve housing under pressure is led to a needle valve back pressure chamber defined by the rear end, which is a larger diameter part, of the needle valve and the valve housing, and to a fuel reservoir defined by the head side part, which is a smaller diameter part, of the needle valve and the valve housing, the pressure regulating port is opened and closed by the pilot valve thereby to vary the pressure in the needle valve back pressure chamber, and the nozzle is opened and closed by the needle valve according to such pressure variations, and wherein:

a groove is formed on the peripheral surface of the needle valve in its larger diameter part, and fuel fed from the fuel inlet port into the valve housing under pressure is led to the needle valve back pressure chamber along the groove;

the opening of the pressure regulating port is increased or decreased according to the lift of the pilot valve, whereby the needle valve moves to match the flow rate of the fuel passing through the pressure regulating port to flow out of the valve housing so as to increase or decrease the opening area of the groove facing the needle valve back pressure chamber whereby the lift of the needle valve is determined, so that the opening rate of the nozzle is increased or decreased;

the pilot valve drive unit is arranged adjacent to the valve housing at the pressure regulating port side, and comprises a pilot valve drive unit housing, a first magnetostrictive rod and a second magnetostrictive rod which are magnetostrictive elements, a magnetostrictive rod supporting member for supporting the first and second magnetostrictive rods, an electromagnet surrounding the first and second magnetostrictive rods and installed in the pilot valve drive unit housing, and a pilot valve supporting member;

the first and second magnetostrictive rods are arranged side by side with each other and in parallel to the operating direction of the pilot valve;

one end of the first magnetostrictive rod is engaged with the pilot valve drive unit housing at the pilot valve side and the other end of the same is engaged with the magnetostrictive rod supporting member at the opposite side to the pilot valve;

one end of the second magnetostrictive rod is engaged with the magnetostrictive rod supporting member at the pilot valve side, and the other end of the same is engaged with the pilot valve supporting member at the opposite side to the pilot valve; and the lift of the pilot valve is determined by a total elongation of the first and second magnetostrictive rods by virtue of the magnetic field effect of the electromagnet.

Preferred embodiments of the invention in such a pressure-storage type fuel injection device for internal combustion engines are as follows.

(1) The pressure regulating port is closed in a state that the electromagnet is de-energized and thus the first and second magnetostrictive rods are contracted, and the pressure regulating port is opened in a state that the electromagnet is excited and the first and second magnetostrictive rods are elongated.

(2) The magnetostrictive rod supporting member is a hollow body having a plurality of blind holes inside, the blind holes having first blind holes formed from the end at the pressure regulating port side toward the other side and second-blind holes formed from the end at the other side toward the pressure regulating port side, the first magnetostrictive rods being inserted into the first blind holes, and the second magnetostrictive rods being inserted into the second blind holes.

(3) The magnetostrictive rod supporting member is a hollow cylindrical body having three each, or six in total, of the first and second blind holes arranged alternately in the circumferential direction of the cylindrical body.

(4) The magnetostrictive material from which the first and second magnetostrictive rods are made and the material from which the magnetostrictive rod supporting member is made have substantially the same thermal expansion coefficient (i.e. a coefficient of linear expansion).

(5) The material from which the magnetostrictive rod supporting member is made and the other material from which the pilot valve supporting member is made are selected so as to cancel an adverse effect on the stroke of the pilot valve due to a thermal expansion of the magnetostrictive material from which the first and second magnetostrictive rods are made.

(6) A bias spring is interposed between the valve housing of the pilot valve drive unit and the magnetostrictive rod supporting member so that a preload of compression is applied axially to the first and second magnetostrictive rods.

In the present invention, the magnetostrictive material from which the magnetostrictive rods are made are elongated or contracted by the effect of an external magnetic field. Among others, a giant-magnetostrictive material made of a ferro-alloy containing terbium (Tb) and dysprosium (Dy), both rare earth elements, is strained at a very high speed response to variations in the external magnetic field to elongate or contract with a large force. A giant-magnetostrictive material exhibits a large magnetostrictive constant (extent of magnetostriction in the saturated state) and the extent of magnetostriction is about $1500\times10^{-6}$ at the maximum, when a pre-stress of compression of about 7 to 14 MPa is axially given. Since a magnetostrictive material (or a magnetostrictive element), unlike a piezo-electric element, requires no electrical wiring to the element, it is possible to separate an electrical constituent section and a mechanical driving section from each other, and to give a magnetic field by the solenoid at a low voltage, so that the magnetostrictive material is advantageously used under an environment with light oil, such as in diesel engines.

The pressure-storage type fuel injection device of the invention is so constructed that the pressure of fuel in the needle valve back pressure chamber, the fuel being fed from a high pressure fuel pump into a valve housing through a pressure storage chamber (i.e. a common rail) and further led to a needle valve back pressure chamber through a groove formed on the needle valve, is controlled by a pilot valve drive unit. It is noted that the fuel pressure in the pressure storage chamber (i.e. the common rail) is adjusted by a feedback control so as to be identical to a previously determined optimum level corresponding to the engine speed and load.

Since the upper end, i.e. the part facing the needle valve back pressure chamber, of the groove formed on the peripheral surface of the needle valve is always in communication with the inside of the needle valve back pressure chamber, the fuel pressure in the pressure storage chamber (i.e. the common rail) is led into the needle valve back pressure chamber. When the pilot valve drive unit is in a de-energized state, the pressure regulating port is closed (cut off) by the pilot valve. In this state, since the pressure in the needle valve back pressure chamber and that in the fuel reservoir are identical, the difference in the area exposed to pressure between the larger diameter part (rear end side) and the smaller diameter part (head side part) of the needle valve causes the needle valve to be pushed against the valve seat close to the nozzle. On the other hand, when the electromagnet is excited to actuate the pilot valve drive unit, the first and the second magnetostrictive rods are elongated by a magnetostrictive effect to lift the pilot valve, whereby the pressure regulating port is opened to a degree corresponding to the lift of the pilot valve. As a result, high pressure fuel in the needle valve back pressure chamber flows out through the pressure regulating port to reduce the pressure in the needle valve back pressure chamber, whereby the upward thrust working on the needle valve becomes dominant to lift the needle valve, and the nozzle is opened to a degree corresponding to the lift of the valve. Thus the nozzle is opened and closed by the alternate repetition of excitation and de-excitation of the electromagnet. That is to say, the injection timing can be controlled by the choice of the timing of electrifying the electromagnet of the pilot valve drive unit, and the duration of injection can be controlled by the choice of the duration of electrifying the electromagnet. This means that the injection rate pattern can be selected and controlled as desired.

The drive of the pilot valve with utilization of the electromagnet is accomplished preferably by connecting a pilot valve rod formed integrally with the pilot valve to the magnetostrictive rod supporting member and causing the magnetostrictive rods to be magnetostrictively elongated. While long magnetostrictive rods would otherwise be needed in order to achieve a sufficient displacement of the pilot valve, since the pilot valve drive unit can not be a long size due to a constraint of the space available for disposing it to the engine, the magnetostrictive rods are arranged in parallel (a tandem arrangement) to reduce the length size.

BEST MODE FOR CARRYING OUT THE INVENTION

Herein below, there will be described preferred embodiments of the invention with reference to the accompanying drawings.

Figure 1:
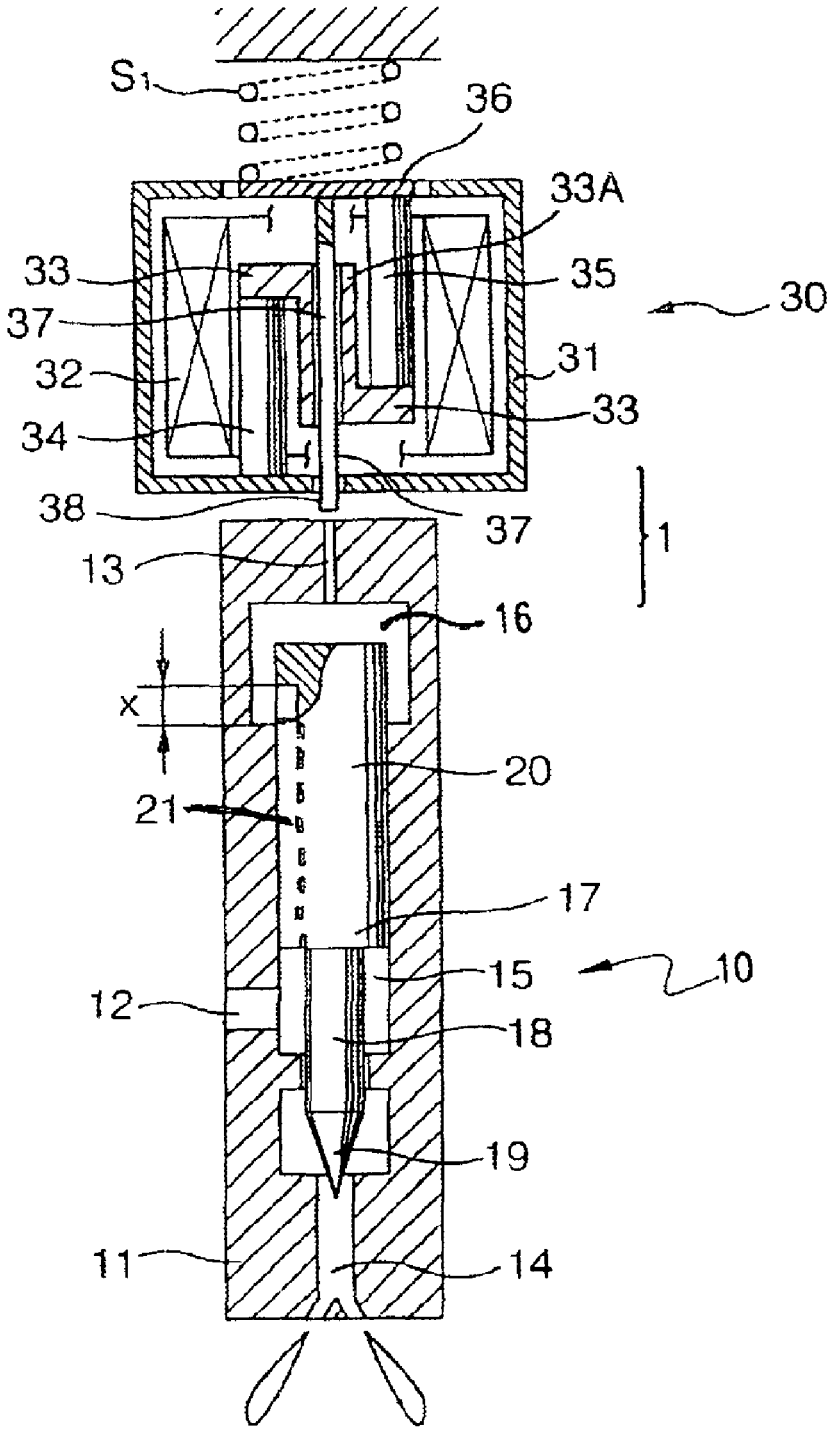
FIG. 1 is a schematic vertical sectional view of one embodiment of a pressure-storage type fuel injection device for internal combustion engines according to the present invention.
Figure 2:
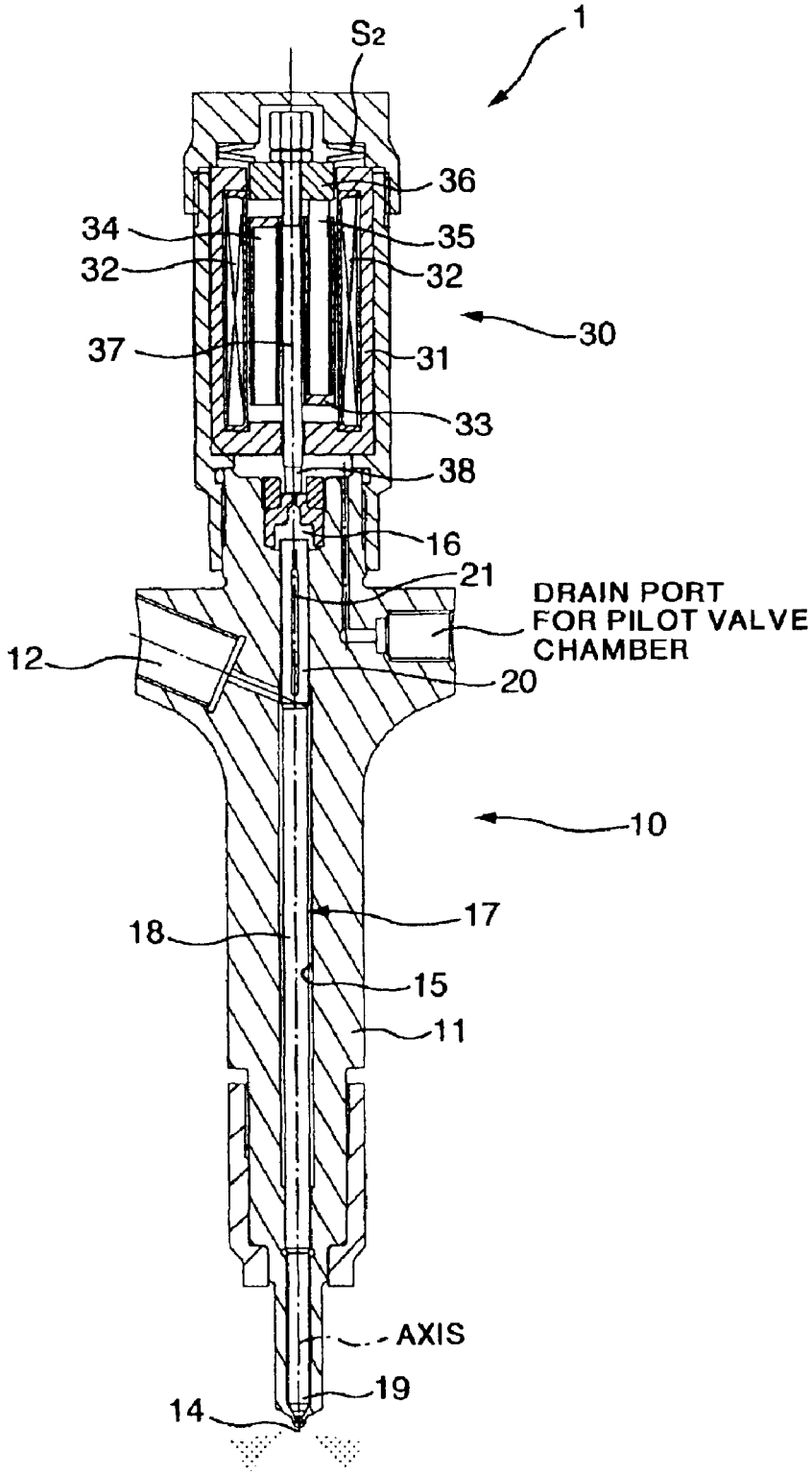
FIG. 2 is a vertical sectional view of a structure which is one application of the device shown in FIG. 1.

FIG. 1 schematically shows one embodiment of a pressure-storage type fuel injection device for internal combustion engines according to the present invention, and FIG. 2 a vertical sectional view of a structure which is one application of the device. In the both drawings, the common reference numerals denote the same components, respectively.

The fuel injection device 1 is comprised of a main unit of injection device 10 and a pilot valve drive unit 30. The pilot valve drive unit 30 is intended for regulating the pressure of fuel fed into the main unit of injection device 10, and moving a needle valve as a main valve, whereby causing the fuel injection device 1 to perform injection.

Main Unit of Injection Device

The main unit of injection device 10 is primarily composed of a valve housing 11 of a hollow cylinder and a needle valve 17 axially slidably installed in the inner chamber of the valve housing 11. The valve housing 11 is provided with a fuel inlet port 12, a pressure regulating port 13 and a nozzle 14. Fuel is supplied under pressure from a common rail, or a pressure storage chamber, to the fuel inlet port 12. The pressure regulating port 13 is formed in the end wall opposite to the nozzle 19, and positioned adjacently to the pilot valve drive unit 30.

The inner chamber of the valve housing 11 comprises a fuel reservoir 15 at the head side part of the needle valve and a needle valve back pressure chamber 16 at the rear side part of the needle valve.

The needle valve 17 of a round bar with a step consists of a smaller diameter part 18 having a tapered head tip 19 and a larger diameter part 20. When the needle valve 17 is positioned at the lower limit and the head tip 19 is in contact with a valve seat face close to the nozzle 14, the nozzle 14 is closed. When the needle valve 17 is lifted and the tip 19 leaves from the valve seat face, the nozzle 14 is opened, and a quantity of fuel corresponding to the lift of the needle valve 17 is injected from the nozzle 14.

The needle valve 17 has an axially formed groove (a channel for fluid) 21 in the larger diameter part 20. The groove 21 is present from the lower end of the larger diameter part 20 facing the fuel reservoir 15 to a position near the upper end of the larger diameter part 20 facing the needle valve back pressure chamber 16. The larger diameter part 20 is predominantly fitted slidably in the inner wall of the valve housing 11 between the fuel reservoir 15 and the needle valve back pressure chamber 16, and whereby the fuel flows only through the groove 21 between the fuel reservoir 15 and the needle valve back pressure chamber 16. The flow rate of the fuel from the fuel reservoir 15 to the needle valve back pressure chamber 16 is determined by the length of the groove 21 facing the inside of the needle valve back pressure chamber 16, i.e. an "opening x". The opening ($x>0$) varies in proportion to the lift of the needle valve 17.

Pilot Valve Drive Unit

The pilot valve drive unit 30 comprises a pilot valve drive unit housing 31, a solenoid (electromagnet) 32 installed in the housing, a first and a second magnetostrictive rods 34, 35 arranged in the central space of the solenoid 32 which are made of a giant-magnetostrictive material, and a magnetostrictive rod supporting member 33.

In the schematic drawing of FIG. 1, the magnetostrictive rod supporting member 33 has a generally Z-shaped longitudinal section, and the upper end of the first magnetostrictive rod 34 and the lower end of the second magnetostrictive rod 35 are connected, respectively, to the upper and lower end walls, as illustrated in the drawing, of the supporting member. The lower end of the first magnetostrictive rod 34 is connected to the under wall of the pilot valve drive unit housing 31, and the upper end of the second magnetostrictive rod 35 is connected to a pilot valve supporting member 36 which is referred to below.

There is arranged a pilot valve rod 37 so as to pass through a hollow cylindrical part 33A of the magnetostrictive rod supporting member 33 in a loosely fitted manner, which is connected to the pilot valve supporting member 36 as a plate at the upper end thereof and of which head end serves as a pilot valve 38. The pilot valve rod 37 is arranged parallel to the axis of the valve housing 11 and the needle valve 17, and to the first and second magnetostrictive rods 34, 35. With regard to the arrangement relationship between the first and second magnetostrictive rods 34, 35, preferably they overlap transversely with each other throughout the most of those lengths. In other words, preferably the lower end of the second magnetostrictive rod 35 is as close as possible to the level of the lower end height of the first magnetostrictive rod 34. This makes it possible to enough reduce the size of the pilot valve drive unit 30.

Operation (1) Closed state of the pilot valve 38: Since the pressure in the needle valve back pressure chamber 16 and the fuel feed pressure, i.e. the pressure in the fuel reservoir 15, are equal to each other through the groove 21, the needle valve 17 is pushed against the valve seat face close to the nozzle 14 by virtue of a difference in pressure receiving area between the larger diameter part and the smaller diameter part of the needle valve, whereby sealing under a high pressure can be maintained.

(2) Open state of the pilot valve: The needle valve 17 is positioned in a location where the fuel pressure loaded on the needle valve 17 is balanced (i.e. the position where the opening area of the groove 21 (opening x) and the opening area of the pressure regulating port 13 (pilot valve opening) is identical to each other).

Since the opening area of the groove 21 (opening x) varies in a linear function relative to the needle valve lift, the needle valve lift is controlled in proportion to the opening area of the pressure regulating port 13 (the opening means the pilot valve opening). In order to obtain the required needle valve lift and response speed, the stroke of the first and second magnetostrictive rods 34, 35, as the giant-magneto strictive actuators which determines the opening area of the pressure regulating port 13 (the opening means pilot valve opening), corresponding to the magnetostrictive expansion length under the effect of a magnetic field, is as small as $1500\times10^{-6}$ of the total length of the first and second magnetostrictive rods 34, 35, so that it is necessary, to match those short strokes, to design the opening area of the groove 21 (i.e. the opening x) so as to equalize the fuel flow rate in the groove 21 and the flow rate of the pressure regulating port 13 controlled by the pilot valve 38.

The giant-magnetostrictive material, from which the first and second magnetostrictive rods 34, 35 are made, the rods being main members of the pilot valve drive unit 30 as giant-magnetostrictive actuators (linear actuators), is a ferrous alloy containing terbium (Tb) and dysprosium (Dy) which are rare earth elements. It expands or contracts as strained by variations in the magnetic field attributable to the solenoid 32. A giant-magnetostrictive material has a characteristic to manifest a large magnetostrictive constant (extent of magnetostrictivn in the saturated state) when an advance compressive stress (i.e. pre-stress) of about 7 to 14 MPa is given in the axial direction (see a compressive coil spring $S_1$ biasing the pilot valve supporting member 36 in FIG. 1 and a disk spring $S_2$ biasing the pilot valve supporting member 36 in FIG. 2), and the extent of magnetostrictivn is about $1500\times10^{-6}$ at the maximum.

When the solenoid 32 is excited, the first and second magnetostrictive rods 34, 35 are elongated to thrust the pilot valve supporting member 36 upward, as illustrated in FIG. 1, and the pilot valve rod 37 connected thereto is displaced upward. In order to ensure sufficient displacement of the pilot valve rod 37, long magnetostrictive rods are required, but the pilot valve drive unit 30 is prevented by the limitation of the space available for fitting to the engine from increasing its length (in the vertical direction in FIG. 1), and accordingly a size reduction is achieved by arranging the magnetostrictive rods in parallel (under a tandem arrangement).

As shown in FIG. 1, the pilot valve drive unit 30 is so constructed that a total elongation of the first and second magnetostrictive rods 34, 35 by a magnetic field effect can be obtained via the magnetostrictive rod supporting member 33, whereby an equal displacement to that of twice as long the magnetostrictive rod can be obtained, without actually increasing the length of the pilot valve drive unit 30, by using the elongation for moving the pilot valve rod 37.

Since the movement of the magnetostrictive rods is very small, a thermal expansion of the magnetostrictive rods due to a temperature change in the ambience may become too great to ignore in controlling the pilot valve lift, and therefore it is necessary to reduce the temperature drift. Thus, in the present embodiment of the invention, an elongation of the magnetostrictive rods due to thermal expansion is cancelled by using a material having substantially the same thermal expansion coefficient (coefficient of linear expansion) as that of the giant-magnetostrictive rods for not only the magnetostrictive rod supporting member 33 but also the pilot valve rod 37, whereby a temperature drift of the displacement of the pilot valve rod 37 can be prevented.

Further to enable the pilot valve drive unit 30 to be driven as a high response giant-magnetostrictive actuator, the winding number of the coil is minimized and the drive is accomplished with an over-excitation erasing circuit so that the inductance of the solenoid 32 can be prevented from delaying the current without changing the maximum displacement. In addition, to compensate for the delaying of the magnetic field by the over-current arising in magnetic circuits when the magnetostrictive rods, which are giant-magnetostrictive elements, are magnetized, the magnetic circuits are designed to use materials of high specific resistance and thereby not to prevent size reduction.

By single injection by one pulse of injection command, the opening of the pilot valve 38 takes two positions including one of closure and the other of maximum opening, and therefore the injection rate shape is rectangular. However, since a steep rise of the injection rate would invite an increase in NOx emission, it is desirable to gradually raise the injection rate in a ramp waveform and to stop injection promptly with a view to reducing black smoke. As such an injection rate waveform is appropriately and variably controlled according to the engine load and speed, it is made possible to electrically set any desired rise characteristic of the injection rate by controlling the magnetizing current of the solenoid 32.

For instance, the magnetizing current of the solenoid is controlled by subjecting the solenoid magnetizing voltage to pulse width modulation in a sufficiently shorter period than the time constant of current variation, which is obtained from the inductance and electric resistance of the solenoid.

Figure 3:
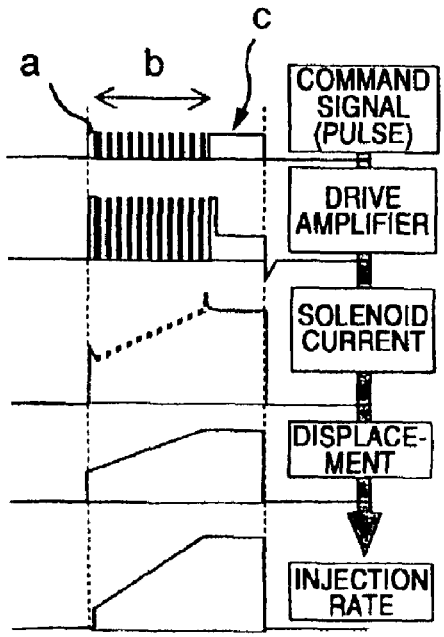
FIG. 3 is a conceptual diagram showing the current, a voltage waveform and a displacement of an actuator made of the giant-magnetostrictive material (a driving displacement for the pilot valve) for forming a target injection rate pattern (waveform) with the invention device.

FIG. 3 is a conceptual diagram showing the current, a voltage waveform and a displacement of an actuator made of the giant-magnetostrictive material (a driving displacement for the pilot valve) for forming a target injection rate pattern (waveform). The input signal for obtaining the target injection rate pattern consists of a compensation pulse (a) for reducing the delay of injection start, a pulse width modulation region (b) for controlling the rise characteristic after the injection start, and a steady state region (c).

In the drive circuit, since the width of one pulse is not greater than the over-excitation time in the compensation pulse and in the pulse width modulation region, the solenoid magnetizing current is controlled with a high voltage pulse for over-excitation use. When the pulse width modulation region ends and a shift to the steady state takes place, one shot high voltage pulse for the over-excitation time is applied, followed by a change-over to a low voltage for the steady state.

It is noted that in the pulse width modulation region (b), its inclination can be varied by controlling the solenoid current with a magnetizing voltage by pulse width modulation in a sufficiently shorter period than the time constant of the solenoid (electromagnet). That is, the solenoid current is controlled by varying the duty ratio of the pulse width, and the actuator displacement (pilot valve drive displacement) of the giant-magnetostrictive material is varied accordingly to enable the inclination of the injection rate and other factors to be controlled. If the current is similarly controlled, regulation of the solenoid magnetizing current with a D.C. analog signal, by frequency modulation or otherwise would enable the injection rate waveform to be appropriately and variably controlled according to the engine load and speed in the same way as described above.

According to the invention embodiment, as shown in FIG. 3, it is possible to vary the solenoid current over time to a desired value with a command pulse selected as desired according to the state of load on the engine, and appropriately set the injection rate pattern (waveform) as the displacement distance of the pilot valve rod 37, i.e. the displacement distance of the pilot valve 38 and as the desired running characteristic of the vehicle.

FIGS. 4A–4D show some realizable examples of the injection rate shape (waveform).

Figure 4A:
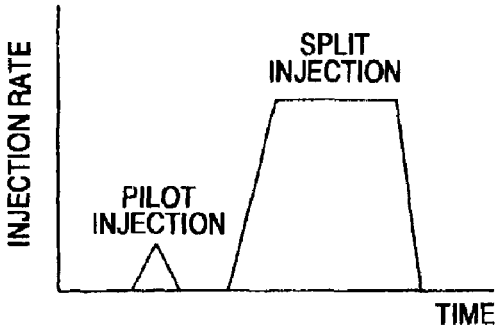
FIG. 4A is a graph showing the injection rate pattern of split injection (pilot injection) as one example which can be realized with the invention device.

(1) FIG. 4A shows an example of split injection (pilot injection).

Figure 4B:
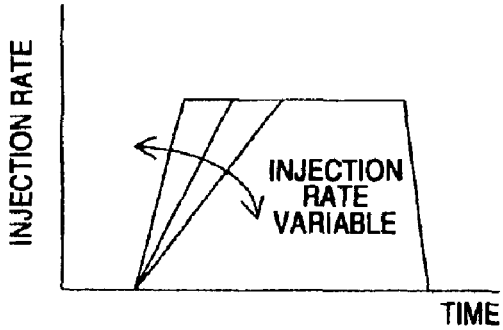
FIG. 4B is a graph showing the injection rate pattern according to another example realizable with the invention device, which shows that an initial rise gradient of the injection rate is variable differently by controlling a solenoid current with a magnetizing voltage using pulse width modulation.

(2) FIG. 4B shows that the initial inclination of the injection rate can be varied in many ways by controlling the solenoid current with a magnetizing voltage using pulse width modulation.

Figure 4C:
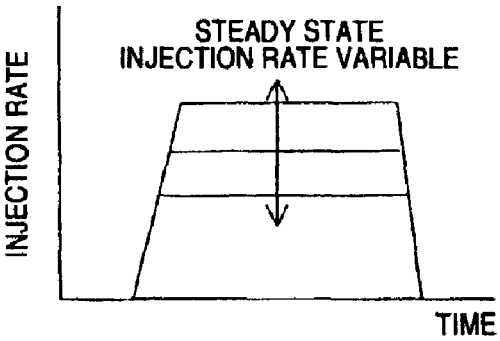
FIG. 4C is a graph showing the injection rate pattern according to still another example realizable with the invention device, which shows that the injection rate is variable in the steady state.

(3) FIG. 4C shows that the injection rate can be varied in the steady state.

Figure 4D:
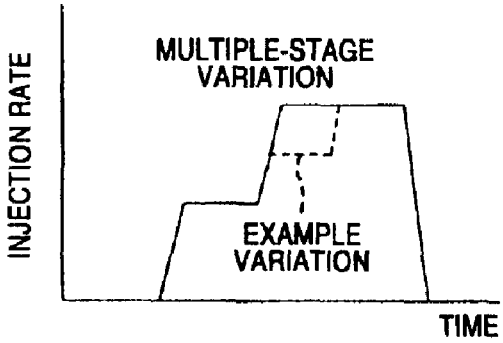
FIG. 4D is a graph showing the injection rate pattern according to still another example realizable with the invention device, which shows that the injection rate is variable in multiple stages.

(4) FIG. 4D shows that the injection rate can be varied in multiple stages.

FIG. 2 is a vertical sectional view of a structure which is one application of the device shown in FIG. 1

Next, there will be described the application structure shown in FIG. 2 (see also FIGS. 5A and 5B).

Figure 5A:
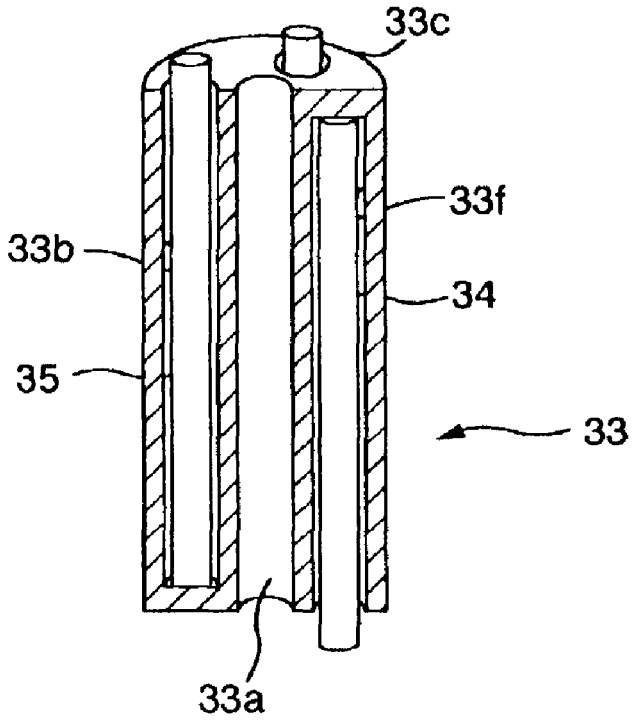
FIG. 5A is a partially sectioned perspective view showing an essential part of a pilot valve drive unit in the device shown in FIG. 2.
Figure 5B:
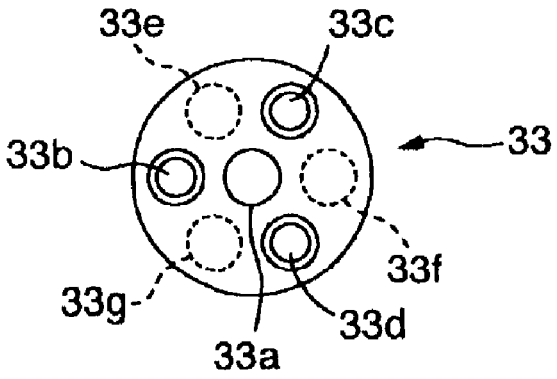
FIG. 5B is an end view of the member shown in FIG. 5A.

The magnetostrictive rod supporting member 33 of the pilot valve drive unit 30, as shown in FIGS. 5A and 5B, is a cylindrical body having, in addition to a central bore 33*a*, six blind holes (bottomed holes) 33*b*, 33*c*, 33*d*, 33*e*, 33*f* and 33*g*. The respective groups of three blind holes 33*b*, 33*c* and 33*d*, and 33*e*, 33*f* and 33*g* are formed in the same direction (opening in the same direction). First magnetostrictive rods 34 are inserted into the group of blind holes 33*e*, 33*f* and 33*g*, and second magnetostrictive rods 35 are inserted into the group of blind holes 33*b*, 33*c* and 33*d*. That is, there are arranged three each of the first magnetostrictive rods 34 and of the second magnetostrictive rods 35. The six blind holes are arranged in a zigzag pattern at equal intervals along the circumference of the cylindrical magnetostrictive rod supporting member 33. This symmetrically arranged structure of the magnetostrictive rods can effectively prevent a bending moment from working on the magnetostrictive rods and the pilot valve rod 37 when the magnetostrictive rods are extended or contracted by variations in the magnetic field attributable to the solenoid 32.

Herein below, there will be described advantages of the present invention.

(1) Since the magnetostrictive rods are used in the pilot valve drive unit and the pilot valve is driven by utilizing the magnetostrictive effect of the magnetostrictive rods attributable by the action of an external magnetic field makes it possible to control continuously and variably without steps the extension quantity of the magnetostrictive rods according to the intensity of the external magnetic field and to regulate the opening degree of the pressure regulation port by the stepless control of the lift of the pilot valve. This means that the internal combustion can be controlled to any optimal conditions, reduce the harmful content in the exhaust to the practicable minimum, and thereby effectively restrain adverse effects on the environment.

(2) By providing the magnetostrictive rods with an advance compressive stress (pre-stress) of about 7 to 14 MPa in the axial direction, it is made possible to have the magnetostrictive effect fully exerted to extend the magnetostrictive rods sufficiently and thereby to lift the pilot valve sufficiently. It should be noted among other things that the application of the advance compressive stress causes the giant-magnetostrictive material to manifest a large magnetostrictive constant (extent of magnetostriction in the saturated state), and its extent of magnetostriction reaches a maximum of about $1500\times10^{-6}$.

(3) The arrangement of one or more pairs of magnetostrictive rods side by side in parallel to the axis of the pilot valve drive unit (tandem configuration of the giant-magnetostrictive actuator) contributes more to reducing the size of the pilot valve drive unit than does the use of one or more sets of one long magnetostrictive rods each.

(4) The hollow cylindrical structure of the magnetostrictive rod supporting member and the alternate arrangement of three each, or six in total, of first and second blind holes, with the first magnetostrictive rods being inserted into the first blind holes and the second magnetostrictive rods being inserted into the second blind holes so that the magnetostrictive rods be arranged at equal intervals in the circumferential direction of the hollow cylindrical body, can effectively restrain any bending moment from working on the magnetostrictive rods which are incompliant with bending loads.

(5) Especially, giant-magnetostrictive materials are very quick in responding to variations in the external magnetic field to be strained, extend or contract and generate a great force. By composing the magnetostrictive rods of a giant-magnetostrictive material, it is made possible to control the pilot valve opening at higher speed and with higher accuracy, and accordingly to control the needle valve lift at higher speed and with higher accuracy.

(6) It is possible to operate the magnetostrictive rods, accordingly the pilot valve, with an injection command signal by D.C. analog, by pulse width modulation or frequency modulation or otherwise, and thereby to control the injection rate shape continuously and variably without any steps. This enables the optimal injection rate shape to be set according to variations in the engine speed and load level and the pressure in the accumulating chamber, which was impossible according to the prior art.

(7) As a magnetostrictive material is used for the drive element of the pilot valve, there is no electrode wiring to the element unlike where a piezo-electric element is used. Therefore, electrical constituent parts and mechanical constituent parts can be separated from each other, and moreover a magnetic field can be provided by the solenoid at a low voltage, making the valve more suitable for use in an environment of light oil combustion, such as in a diesel engine.

Industrial Applicability

The invention can make it possible to reduce harmful contents in exhaust gas by equipping an internal combustion engine with a fuel injection device capable of variably controlling the injection rate pattern (transitional variations) under a broad range of injection pressure, from low pressure to high pressure.

What is claimed is:

1. A pressure-storage type fuel injection device for internal combustion engines with a pilot valve drive unit, comprising:

a valve housing having a nozzle at one end; a needle valve reciprocally installed in a valve or inner chamber of the valve housing; and a pilot valve drive unit provided with a pilot valve for controlling a fuel pressure applied to a rear end of the needle valve, a fuel inlet port and a pressure regulating port being formed in the valve housing, wherein fuel fed from the fuel inlet port into the valve housing under pressure is led to a needle valve back pressure chamber defined by the rear end, which is a larger diameter part, of the needle valve and the valve housing, and to a fuel reservoir defined by a head side part, which is a smaller diameter part, of the needle valve and the valve housing, the pressure regulating port is opened and closed by the pilot valve thereby to vary the pressure in the needle valve back pressure chamber, and the nozzle is opened and closed by the needle valve according to such pressure variations, and wherein:

a groove is formed on the peripheral surface of the needle valve in its larger diameter part, and fuel fed from the fuel inlet port into the valve housing under pressure is led to the needle valve back pressure chamber along the groove;

the opening of the pressure regulating port is increased or decreased according to the lift of the pilot valve, whereby the needle valve moves to match a flow rate of the fuel passing through the pressure regulating port to flow out of the valve housing so as to increase or decrease the opening area of the groove facing the needle valve back pressure chamber whereby the lift of the needle valve is determined, so that the opening rate of the nozzle is increased or decreased; the pilot valve drive unit is arranged adjacent to the valve housing at the pressure regulating port side, and comprises a pilot valve drive unit housing, a first magnetostrictive rod and a second magnetostrictive rod which are magnetostrictive elements, a magnetostrictive rod supporting member for supporting the first and second magnetostrictive rods, an electromagnet surrounding the first and second magnetostrictive rods and installed in the pilot valve drive unit housing, and a pilot valve supporting member;

the first and second magnetostrictive rods are arranged side by side with each other and in parallel to the operating direction of the pilot valve;

one end of the first magnetostrictive rod is engaged with the pilot valve drive unit housing at the pilot valve side and the other end of the first magnetostritive rod is engaged with the magnetostrictive rod supporting member at the opposite side to the pilot valve;

one end of the second magnetostrictive rod is engaged with the magnetostrictive rod supporting member at the pilot valve side, and the other end of the second magnetostritive rod is engaged with the pilot valve supporting member at the opposite side to the pilot valve; and the lift of the pilot valve is determined by a total elongation of the first and second magnetostrictive rods by virtue of the magnetic field effect of the electromagnet.

2. A pressure-storage type fuel injection device according to claim 1, wherein the pressure regulating port is closed in a state that the electromagnet is de-energized and thus the first and second magnetostrictive rods are contracted, and the pressure regulating port is opened in a state that the electromagnet is excited and the first and second magnetostrictive rods are elongated.

3. A pressure-storage type fuel injection device according to claim 1, wherein the magnetostrictive rod supporting member comprises a hollow body having a plurality of blind holes inside, the blind holes having first blind holes formed from the end at the pressure regulating port side toward the other side and second blind holes formed from the end at the other side toward the pressure regulating port side, and wherein a plurality of first magnetostrictive rods are inserted into the first blind holes, and a plurality of second magnetostrictive rods are inserted into the second blind holes.

4. A pressure-storage type fuel injection device according to claim 3, wherein the magnetostrictive rod supporting member is a hollow cylindrical body having three each, or six in total, of the first and second blind holes arranged alternately in the circumferential direction of the cylindrical body.

5. A pressure-storage type fuel injection device according to any one of claims 1 to 4, wherein the magnetostrictive material from which the first and second magnetostrictive rods are made and the material from which the magnetostrictive rod supporting member is made have substantially the same thermal expansion coefficient (i.e. a coefficient of linear expansion).

6. A pressure-storage type fuel injection device according to any one of claims 1 to 4, wherein the material from which the magnetostrictive rod supporting member is made and the other material from which the pilot valve supporting member is made are selected so as to cancel an adverse effect on the stroke of the pilot valve due to a thermal expansion of the magnetostrictive material from which the first and second magnetostrictive rods are made.

7. A pressure-storage type fuel injection device according to any one of claims 1 to 4, wherein a bias spring is interposed between the valve housing of the pilot valve drive unit and the magnetostrictive rod supporting member so that a preload of compression is applied axially to the first and second magnetostrictive rods.

* * * * *

UNITED STATES PATENT AND TRADEMARK OFFICE

CERTIFICATE OF CORRECTION

PATENT NO. : 6,945,469 B2
DATED : September 20, 2005
INVENTOR(S) : Hirohisa Tanaka et al.

It is certified that error appears in the above-identified patent and that said Letters Patent is hereby corrected as shown below:

Column 2,
Line 65, replace “second-blind” with -- second blind --.

Column 5,
Line 30, replace “nozzle 19,” with -- nozzle 14, --.

Column 6,
Line 54, replace “magneto strictive” with -- magnetostrictive --.

Column 7,
Lines 6 and 11, replace “magnetostrictivn” with -- magnetostriction --.

Signed and Sealed this

Sixteenth Day of May, 2006

JON W. DUDAS
*Director of the United States Patent and Trademark Office*